US007031638B2

(12) United States Patent
Tanizaki et al.

(10) Patent No.: US 7,031,638 B2
(45) Date of Patent: Apr. 18, 2006

(54) COLOR IMAGE FORMING APPARATUS WITH A REMOVABLE AND INCLINED INTERMEDIATE TRANSFER BODY UNIT

(75) Inventors: Junichi Tanizaki, Fukuoka (JP); Noriyuki Tajima, Osaka (JP); Yoshitaka Kitaoka, Osaka (JP); Yasutaka Tamai, Nara (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 186 days.

(21) Appl. No.: 10/691,611

(22) Filed: Oct. 24, 2003

(65) Prior Publication Data

US 2004/0136747 A1 Jul. 15, 2004

(30) Foreign Application Priority Data

Oct. 25, 2002 (JP) ..... P. 2002-310748
Nov. 8, 2002 (JP) ..... P. 2002-325180

(51) Int. Cl.
*G03G 21/18* (2006.01)
*G03G 15/08* (2006.01)

(52) U.S. Cl. ..... 399/112; 399/121

(58) Field of Classification Search ..... 399/111, 399/112, 121, 124, 299, 302, 308
See application file for complete search history.

(56) References Cited

U.S. PATENT DOCUMENTS 5,444,515 A * 8/1995 Haneda et al. ..... 399/112
6,453,135 B1 * 9/2002 Sameshima et al. ..... 399/110
6,484,003 B1 * 11/2002 Tokutake et al. ..... 399/110
6,647,227 B1 * 11/2003 Yokoi et al. ..... 399/111
6,738,590 B1 * 5/2004 Okimura et al. ..... 399/111
6,873,811 B1 * 3/2005 Huffman et al ..... 399/121

FOREIGN PATENT DOCUMENTS

| | | | |
|---|---|---|---|
| JP | 11-15227 | | 1/1999 |
| JP | 2002072618 A | * | 3/2002 |
| JP | 5-323688 | | 6/2002 |
| JP | 2002-169350 | | 6/2002 |
| JP | 2002-182451 | | 6/2002 |
| JP | 2002-182539 | | 6/2002 |
| JP | 2002-214868 | | 7/2002 |
| JP | 2003-98765 | | 4/2003 |

OTHER PUBLICATIONS

English Language Abstract of JP No. 2002-214868.
English Language Abstract of JP No. 2002-182539.
English Language Abstract of JP No. 2003-986765.
English Language Abstract of JP No. 2002-169350.
English Language Abstract of JP No. 2002-182451.
English Language Abstract of JP No. 5-323688.

* cited by examiner

*Primary Examiner*—Robert Beatty
(74) *Attorney, Agent, or Firm*—Greenblum & Bernstein, P.L.C.

(57) ABSTRACT

A color image forming apparatus having a plurality of developing units for containing different color toners to form a color image, a plurality of photo-receptor units including photo-receptors on which electrostatic latent images to be developed by said developing units are to be formed, and an intermediate transfer body unit including a tensionally provided belt with upper and lower surfaces to which toner images are transferred from said photo-receptors, an intermediate transfer body unit cartridge integrally holding said intermediate transfer body unit, the cartridge being detachably attached to the color image forming apparatus through the jamming-removal opening.

20 Claims, 8 Drawing Sheets

COLOR IMAGE FORMING APPARATUS WITH A REMOVABLE AND INCLINED INTERMEDIATE TRANSFER BODY UNIT

CROSS REFERENCE TO RELATED APPLICATION

This application is based upon and claims the benefit of priority of Japanese Patent Application No. 2002-310748 filed on Oct. 25, 2002, and Japanese Patent Application No. 2002-325180 filed on Nov. 8, 2002, the contents of which are incorporated herein by reference in its entirety.

BACKGROUND OF THE INVENTION

The present invention relates to a color image forming apparatus, and more particularly to a color image forming apparatus of the type in which images formed by a plurality of image forming units are superimposed on an intermediate transfer belt, and those superimposed images are collectively transferred onto a recording sheet.

In a conventional color Xerography basis image forming apparatus, a called tandem type image forming apparatus is employed for the purpose of increasing printing speed. In this type of the apparatus, image forming sections or units are arranged side by side. Toner images are successively superimposed to form a color image.

Each image forming unit is formed with a photo-receptor unit for forming an electrostatic latent image and a developing unit for supplying toner to the photo-receptor unit.

In this type of the image forming apparatus, the image forming units are arranged side by side. Accordingly, the apparatus is long in the direction in which the image forming units are arranged. Further, in a case of where images are superimposed one on another on a recording paper, the fixing units are also arranged side by side. A length of the image forming apparatus is further increased. Consequently, the tandem type image forming apparatus needs an apparatus installing area.

A technique to solve the problem is disclosed in JP-A-11-15227, for example. The technique is directed to the image forming apparatus of the vertically mounting, tandem type.

FIG. 8 is a view schematically showing a conventional image forming apparatus. The conventional image forming apparatus is composed of a plurality of photo-receptors 28*a* (Bk), 28*b* (C), 28*c* (M) and 28*d* (Y) vertically arranged, image forming means for forming images of different colors on the photo-receptors 28*a* to 28*d*, a transport/transfer belt 37 for attracting a transfer sheet conveyed from a registration roller 12 which is disposed facing the photo-receptors 28*a* to 28*d*, and a fixing unit 13 for fixing a composite color image on a transfer sheet having been transported by the transport/transfer belt 37. In the image forming apparatus of the type in which images are superimposed from the photo-receptors 28*a* to 28*d* onto a transfer sheet having been transported by the transport/transfer belt 37, a length of the transfer-sheet transporting path ranging from the registration roller 12 to the first photo-receptor 28*a* (Bk) (=photoreceptor at which the transfer sheet first arrives) of those photo-receptors 28*a* to 28*d* is selected to be ½ or shorter than a length of the passable transfer sheet having the smallest size as viewed in the sheet passing direction.

Further, the publication discloses the image forming apparatus in which a length of the transfer-sheet transporting path ranging from the registration roller 12 to the attracting means is selected to be ½ or shorter than a length of the passable transfer sheet having the smallest size as viewed in the sheet passing direction.

Additionally, the publication discloses the image forming apparatus in which a length of the transfer-sheet transporting path ranging from the photo-receptor 28*d* (Y) (=photoreceptor at which the transfer sheet last arrives) of those photo-receptors 28*a* (Bk), 28*b* (C), 28*c* (M) and 28*d* (Y) to the fixing unit 13 is selected to be ½ or shorter than a length of the passable transfer sheet having the smallest size as viewed in the sheet passing direction.

In the conventional image forming apparatus of the vertically mounting, tandem type, the transport/transfer belt 37 electrostatically attracts a transfer sheet from a sheet supply cassette 9 located in a lower part of the apparatus, transports the transfer sheet in a vertical direction, and successively superimposes color images formed by image forming units 38*a* (Bk), 38*b* (C), 38*c* (M) and 38*d* (Y) on the recording medium to thereby form a color image. Following this, the transfer sheet bearing the thus formed toner image thereon is separated from the transport/transfer belt 37, and transported to a fixing device, and the toner image is fixed on the transfer sheet. A height of the image forming apparatus manufactured by the conventional technique described above is relatively high, but an area occupied by the apparatus when it is installed is reduced.

In the conventional technique, the toner images are transferred onto a recording medium, such a sheet of paper, in a superimposing manner. Accordingly, the thickness and a moisture absorbing property of the sheet (transfer sheet) and others affect the image transfer. This results in insufficient stability of the image reproduction.

Where a thick recording sheet is passed through the transporting path, a stiffness of the thick recording sheet is strong. Accordingly, the sheet transporting force of the registration roller or the fixing unit is larger than an electrostatic attracting force of the transport/transfer belt. As a result, the recording sheet tends to slip at the attracting part, possibly causing the out-of-color-registration In the event of jamming such as paper jamming during a continuous printing operation, in particular in the event that the recording medium is left at a portion where the images are successively transferred on the recording medium, it is difficult to remove the jammed sheet. In this case, the user handles the sheet having much color toner not fixed yet sticking to there. Accordingly, there is much chance that his/her hands and clothes are frequently soiled, and further the color toner particles fly into the air to contaminate air.

Further, in design, the space between the adjacent color image forming units is reduced as much as possible in order to reduce the apparatus height. Therefore, the component parts are required to be reduced in size, thickness and diameter. This results in insufficient rigidity of the image forming units per se and the drive means. Where the insufficient rigidity is present, it is difficult to secure the positioning accuracy of the image forming units and the drive accuracy as major factors in the image formation. Accordingly, the color image formed is deteriorated in the out-of-color-registration and the color irregularity of the color image.

Further, the image forming units per se are reduced in size. Accordingly, a space used by the user for replacement of the image forming units as expendables is narrow, and the operability is deteriorated in the replacement work.

SUMMARY OF THE INVENTION

Accordingly, an object of the present invention is to provide a color image forming apparatus which is reduced in size, ensures the stable picture quality regardless of the thickness and a moisture absorbing property of the sheet and others, makes it easy for the user to remove a jammed sheet at the time of paper jamming, and provides an easy work of replacing the image forming units as expendables.

The present invention may be described in at least the following conceptual descriptions: (1) A plurality of image forming units are individually positioned to and held with an intermediate transfer body unit; (2) A plurality of photo-receptors are fixedly supported by one housing to form an assembled photo-receptor unit, the assembled photo-receptor unit being positioned to and held with the intermediate transfer body unit; and (3) One of plural photo-receptors is fixed to and supported by one housing to form a photo-receptor unit, and the remaining photo-receptors are fixed to and supported by one housing to form an assembled photo-receptor unit, and the photo-receptor unit and the assembled photo-receptor unit are individually positioned to and held with the intermediate transfer body unit. An intermediate transfer body unit and a plurality of image forming units are integrally assembled. With this feature, in attaching the image forming units to the apparatus main body, sufficient strength of the image forming units is secured while the size of the whole image forming apparatus is reduced. The stable picture quality is ensured regardless of the thickness and a moisture absorbing property of the sheet and others. Further, the user can remove a jammed sheet at the time of paper jamming.

Further, the image forming units have sizes suitable for expendables. A sufficient working space is secured. Operability in the replacing work of the image forming units is enhanced.

Further, the present invention may be described such that image forming units are vertically arranged from upstream to downstream sides as viewed in a color forming process flow, while being successively shifted to optical units which are respectively arranged adjacent to the image forming units and at the same heights as of the image forming units. This feature advantageously brings about reduction of an installation area and a height of a main body of the color image forming apparatus, and a size of the whole image forming apparatus.

DETAILED DESCRIPTION OF THE PREFERRED EMBODIMENTS

<Embodiment 1>

Figure 1:
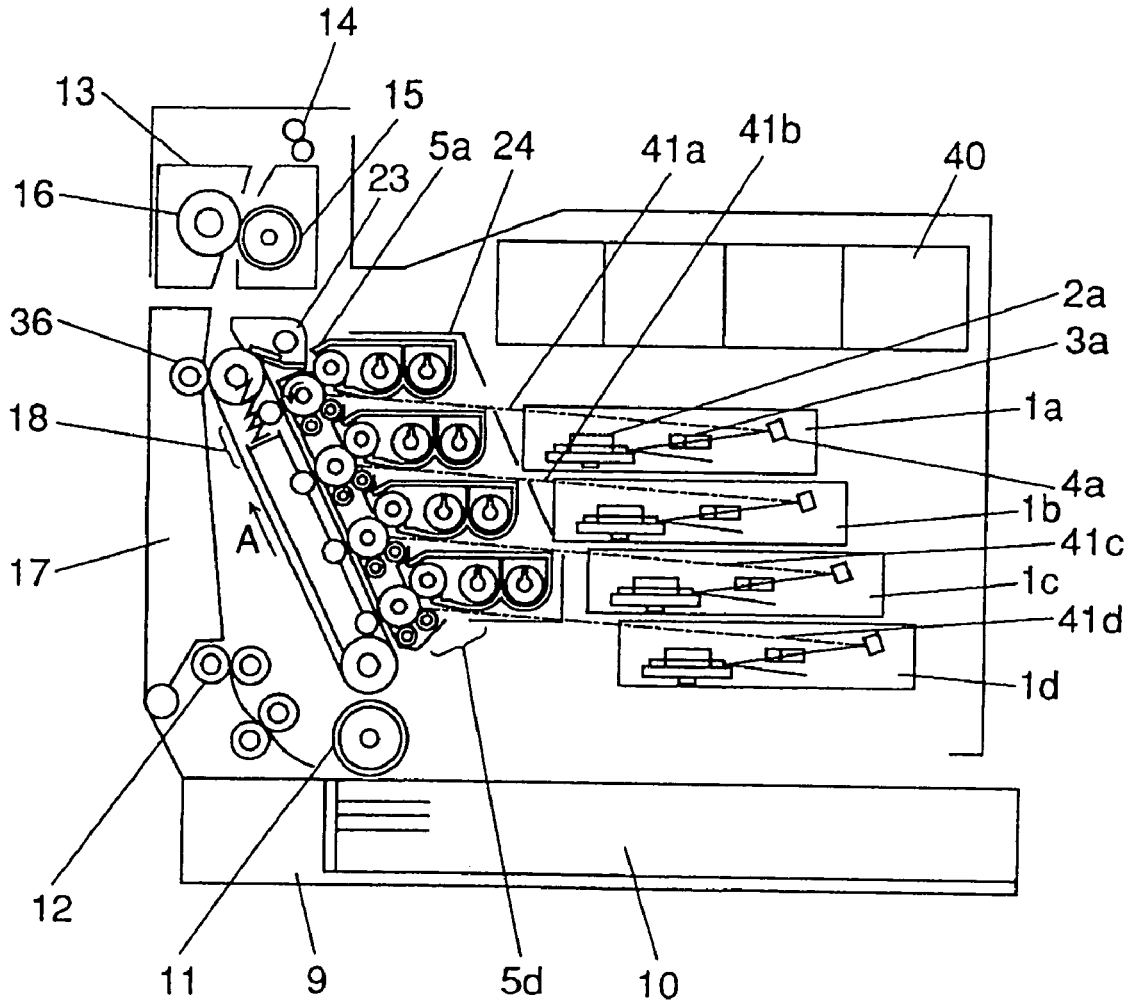
FIG. 1 is a view schematically showing a mechanical arrangement of an image forming apparatus which is an embodiment of the present invention.

In the description of the embodiments, sometimes, components each designated by a reference numeral followed by alphabetical letters are each generally indicated by the reference numeral, for simplicity.

The preferred embodiments of the present invention will be described with reference to the accompanying drawings. FIG. 1 is a view schematically showing a mechanical arrangement of an image forming apparatus which is an embodiment of the present invention. In FIG. 1, within a main body of the image forming apparatus, a transfer roller 36, an intermediate transfer body unit 18, and image forming units (photo-receptor units and developing units) 5*a* to 5*d* are arranged in this order as viewed in the counterclockwise direction on the paper of the drawing. A fixing device 13 is disposed above the image forming units 5*a* to 5*d*. A sheet supply cassette 9 containing recording sheets 10 to be supplied to the apparatus is disposed under the fixing device.

Figure 2:
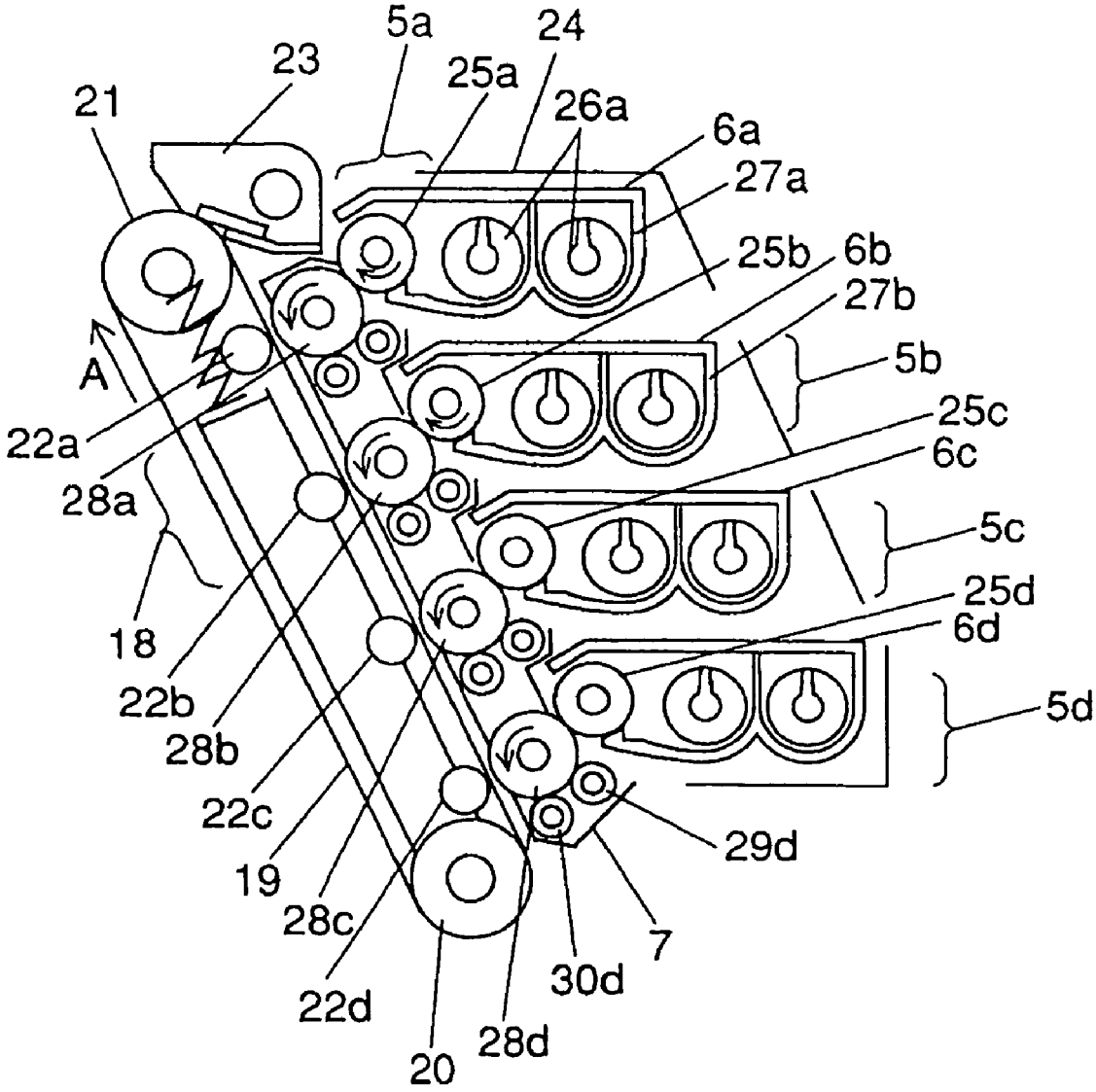
FIG. 2 is a view schematically showing a portion mainly containing an image forming part in the image forming apparatus.

A toner hopper 40 containing individual toners is disposed above the optical units 1 (1*a* to 1*d*). FIG. 2 is a view schematically showing a portion mainly including an image forming part in the image forming apparatus.

In FIGS. 1 and 2, the optical units 1*a* to 1*d*, while corresponding to the respective colors, are disposed on the rear side (right side on the paper surface of the drawing) within the main body of the image forming apparatus. Those optical units emit laser lights 41*a* to 41*d* to photo-receptors 28*a* to 28*d* forming latent images in horizontal directions. The optical units 1 are each made up of a semiconductor laser (not shown), a polygon mirror 2, an image forming lens 3, and a reflecting mirror 4. The polygon mirror 2 receives light emitted from the semiconductor laser (not shown), and deflects it for scanning, and the laser light passes through the image forming lens 3 and the reflecting mirror 4 and lands on an exposure point on a photo-receptor 28.

Image forming units 5 (5*a* to 5*d*) used in the instant embodiment will be described with reference to FIG. 2 and FIG. 4. In each image forming unit 5, a photo-receptor unit 8 (8*a* to 8*d*) and a developing unit 6 (6*a* to 6*d*), which are provided for each color, may be considered to be assembled into one housing. In view of the recent trend of increase of the service life of expendables, it is convenient to sort those components based on the length of the service life and to assemble them into a housing. In this instance, one photo-receptor unit 8 (8*a* to 8*d*) and one developing unit 6 (6*a* to 6*d*) are housed in their own housings, respectively.

The photo-receptor unit 8, as shown, includes a drum-like photo-receptor 28, a charging roll 29 for pre-charging the photo-receptor 28, and a roller cleaner 30, formed with an elastic sponge roll, for removing toner left on the photo-receptor 28. Those components are assembled into a cartridge. The photo-receptor 28 is designed to have a small diameter of 20 mm with the intention of reducing a dimensional size of a space between the adjacent image forming units 5 (5*a* to 5*d*), and of securing a necessary transfer ability.

The roller cleaner 30 takes a shape of roll made of conductive urethane foam. Voltage opposite in polarity to the toner is applied to the roller cleaner 30, and in this state, the roller cleaner 30 is rotated in the same direction as of the photo-receptor 28, while in contact with the latter, to thereby scrape off the residual toner on the photo-receptor 28.

The developing unit 6 (6*a* to 6*d*) includes a developing case 27 (27*a* to 27*d*). The developing case 27 contains a developer containing its related color toner (not shown). A couple of agitators 26 (26*a* to 26*d*) as agitating members are located in the developing case 27. A developing roll 25 (25*a* to 25*d*) is provided at an opening part of the developing case 27, which is confronted with the photo-receptor 28. A developer thickness regulating blade (not shown) for regulating a thickness of the developer on the developing roll 25 is further provided.

Developing bias voltage (not shown) is applied to the developing roll 25. The developing roll thus biased causes the developer (toner) to fly to the photo-receptor 28. A gap between the photo-receptor 28 and the developing roll is adjusted by use of cap rollers which are located at both ends of the developing roll and coaxial with the latter.

Each developing unit 6 (6*a* to 6*d*) used in the instant embodiment may be installed as one unit in a guide part (not shown) of the apparatus main body. In the instant embodiment, however, to improve the maintenance for replacement, the developing units 6 (6*a* to 6*d*) are assembled into one housing such that if necessary, those are movable (The thus assembled developing units will be referred to as an assembled developing unit 24). The assembled developing unit 24 is positioned and fixed in the guide part (not shown) in a state that if necessary, those are slidable toward the photo-receptor 28.

The intermediate transfer body unit 18 includes an intermediate transfer belt 19 which is stretched between two rollers (a lower belt drive roller 20 and an upper belt follower roller 21) and moved in a direction of an arrow A, a plurality of photo-receptors 28 (28*a* to 28*d*) arranged along a transport surface ranging from an upper part of the intermediate transfer belt 19 to a lower part thereof (from up to down in the paper surface of the drawing), and belt backup rollers 22 (22*a* to 22*d*) for primarily transferring toner images from the photo-receptors 28 onto the intermediate transfer belt 19, which the backup rollers are located facing he photo-receptors 28 with respect to the intermediate transfer belt 19. An intermediate transfer belt cleaner 23 is disposed while being confronted with the upper belt follower roller 21, which tensionally supports the intermediate transfer belt 19.

In the instant embodiment, the rotation center shafts of the photo-receptor units 8 (8*a* to 8*d*) are respectively guided by and inserted into photo-receptor guide grooves 34 (34*a* to 34*d*) of unit side plates 33 that are provided on both sides of the intermediate transfer body unit 18, and positioned in and held with the photo-receptor guide grooves 34. With this structural feature, the photo-receptor units 8 (8*a* to 8*d*) and the intermediate transfer body unit 18 maybe handled as if those are integrally assembled into one cartridge.

Figure 3:
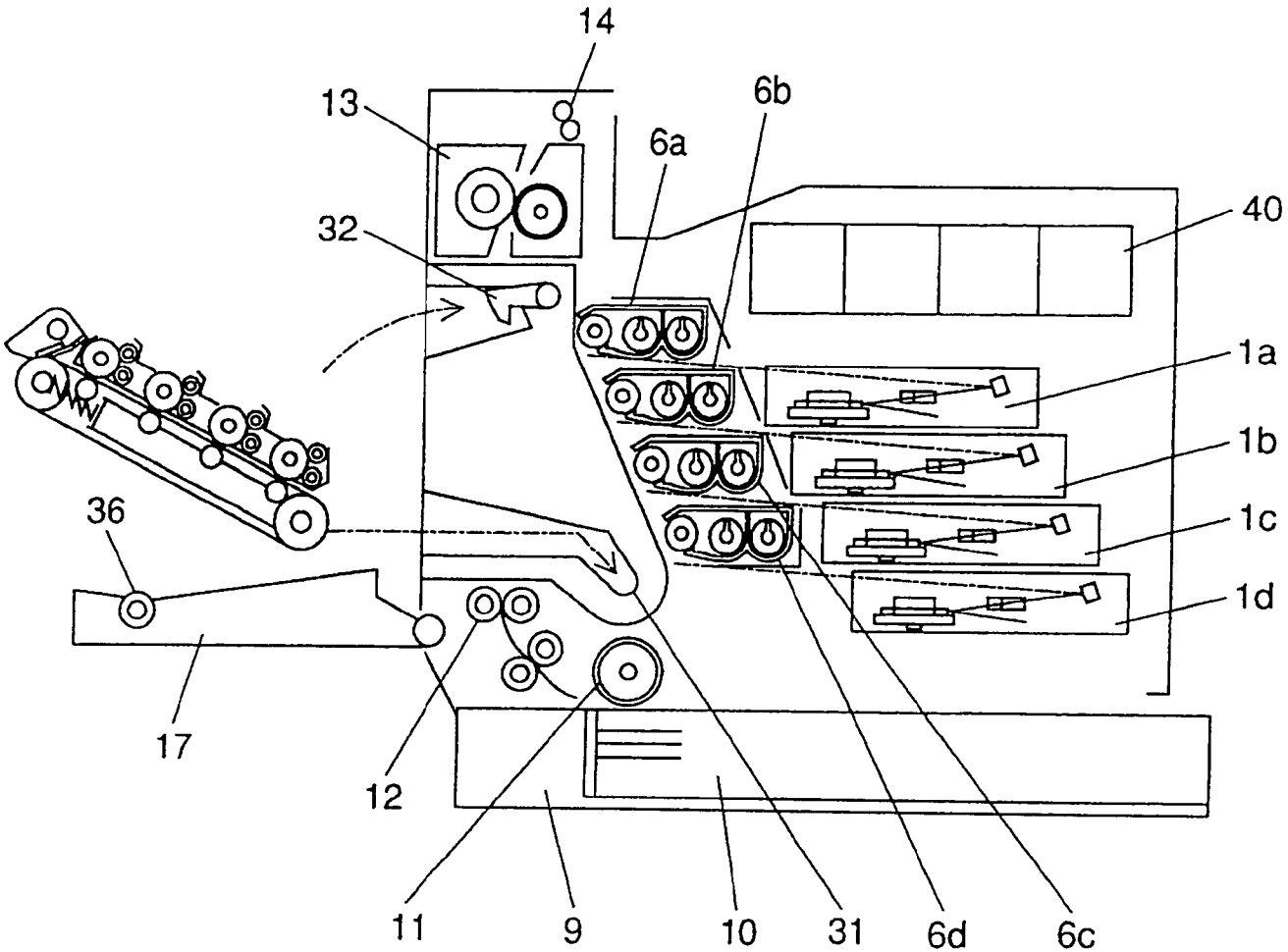
FIG. 3 is a view schematically showing how to attach the image forming units as expendables to and detaching them from the image forming apparatus.

FIG. 3 is a view schematically showing how to attach the image forming units as expendables to and detaching them from the image forming apparatus. FIG. 4 is a view schematically showing the attaching of the image forming units in the first embodiment.

As shown in FIG. 3, a door 17 is attached to the left side of the apparatus main body. When the door 17 is opened, a component attaching opening is formed in the apparatus main body. The assembled developing unit 24 and the integral cartridge of the photo-receptor units 8 (8*a* to 8*d*) and the intermediate transfer body unit 18 are is inserted into and taken out of the apparatus main body.

A transfer roller 36 is mounted on the door 17. When the door 17 is closed, the transfer roller 36 collectively transfers the toner images from the intermediate transfer belt 19 onto a recording sheet at a position where it is confronted with the upper belt follower roller 21 which tensionally supports the intermediate transfer belt 19.

In the instant embodiment, as shown in FIG. 1, the sheet supply cassette 9 includes a feed roll 11 for feeding recording sheets 10 at predetermined timings. A registration roller 12 as nip transporting means is provided at position near an input of a sheet transporting path which is located between the feed roll 11 and a secondary transfer part. A sheet sensor (not shown) of the optical type is located downstream of the registration roller.

In the instant embodiment, the sheet sensor detects the leading edge of the recording sheet 10. A timing of detecting the sheet leading end by the sensor is used for controlling, for example, writing timings of electrostatic latent images in the optical units 1 (1*a* to 1*d*) in the image forming units 5 (5*a* to 5*d*).

A fixing device 13 as nip transfer means is provided on a sheet transporting path, which is located downstream of the secondary transfer part. The fixing device 13 includes a heating roll 15 and a pressing roll 16.

A sheet-discharging roll 14 is located downstream of the fixing device 13. Recording sheets emanating from the sheet-discharging roll are discharged into a sheet receiving tray provided in an upper part of the housing.

Operation of the color image forming apparatus thus constructed will be described with reference to FIGS. 1 and 2. Referring to FIG. 2, in the color image forming apparatus of the instant embodiment, the charging rolls 29 uniformly charge the surfaces of the photo-receptors 28. The optical units 1 optically an image into the photo-receptors 28 by laser light 41 to thereby form latent images on the photo-receptors 28. Thereafter, the developer layer regulating blade (not shown) operates to provide thin toner layers on the developing rolls 25. The toner layers are each charged to have one polarity (plus or minus). In the developing section where the photo-receptors 28 are confronted with the developing rolls 25, the latent images are developed into toner images on the photo-receptors 28.

The toner images thus formed on the photo-receptors 28 are primarily transferred onto the intermediate transfer belt 19 with application of a given voltage to the belt backup rollers 22. In this case, the toner image formed by the most upstream image forming unit 5*a* (=image forming unit located in the most upper stage) is first primary-transferred onto the intermediate transfer belt, and then the toner image formed by the image forming unit 5*b*, is primary-transferred onto the belt and soon. Finally, plural toner images are transferred as a composite color toner image onto the intermediate transfer belt 19.

The recording sheet 10 fed from the sheet supply cassette 9 is transported along the sheet transporting path which is located on the opposite side of the image forming units 5 with respect to the intermediate transfer belt 19. The recording sheet 10 thus transported is inserted into the secondary transfer part which is confronted with the upper belt follower roller 21 of those two rollers (the lower belt drive roller 20 and the upper belt follower roller 21) which tensionally supports the intermediate transfer belt 19.

The toner images on the intermediate transfer belt 19 are secondarily transferred onto the recording sheet 10 in the secondary transport part. The toner (not shown) that is left on the intermediate transfer belt 19 after the secondary transferring operation is removed by the intermediate transfer belt cleaner 23. Subsequently, the composite color toner image is fixed onto the recording sheet 10 by the fixing device 13 to thereby form a color toner image on the recording sheet. In a normal state or image forming state, the transfer roller 36 is in press contact with the intermediate transfer belt 19, and in a jam removal state, it is separated from the same.

As described above, in the embodiment mentioned above, the photo-receptor units are individually positioned to and held by the intermediate transfer body unit. With this unique feature, the photo-receptor units 8 (8*a* to 8*d*) and the intermediate transfer body unit 18 are handled as if those are integrally assembled into one cartridge. This structural feature accrues to many advantages. In attaching the image forming units to the apparatus main body, sufficient strength of the image forming units is secured while the size of the whole image forming apparatus is reduced. The stable picture quality is ensured regardless of the thickness and a moisture absorbing property of the sheet and others. Further, the user can remove a jammed sheet at the time of paper jamming. The image forming units have sizes suitable for expendables. A sufficient working space is secured. Operability in the replacing work of the image forming units is enhanced.

<Embodiment 2>

Figure 5:
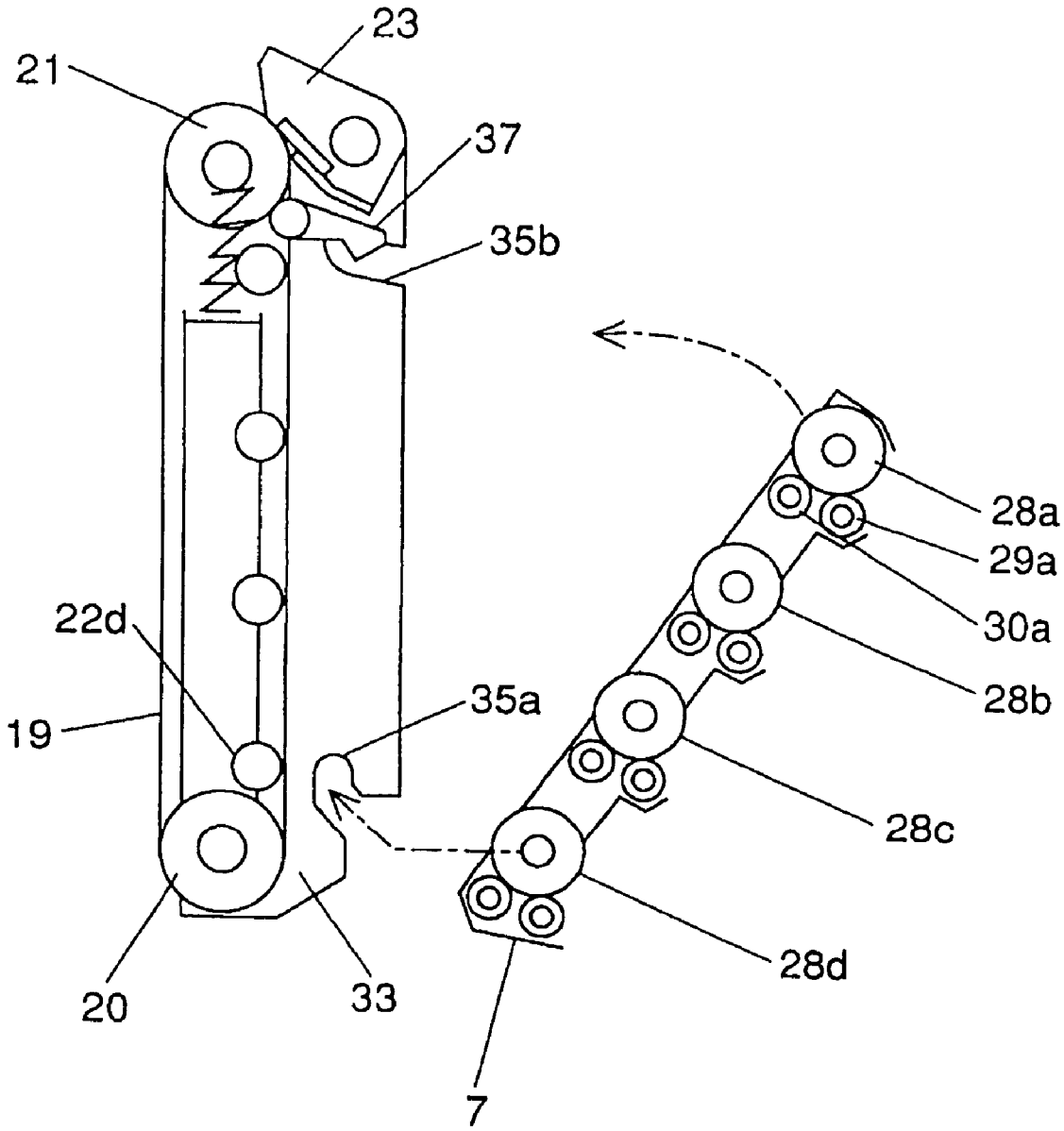
FIG. 5 is a view schematically showing the attaching of the image forming units according to a second embodiment of the invention.

FIG. 5 is a view schematically showing the attaching of the image forming units according to a second embodiment of the invention. No description or only a simple description will be given about the portions in the second embodiment which are the same as and similar to those in the first embodiment. In FIG. 5, plural photo-receptors 28 (28*a* to 28*d*) are assembled into one housing (not shown) to form an assembled photo-receptor unit 7. The photo-receptor units 8 (8*a* to 8*d*) are inserted into photo-receptor guide grooves 35 (35*a* and 35*b*) of unit side plates 33 that are provided on both sides of the intermediate transfer body unit 18 such that the rotation center shafts of the photo-receptors 28*a* and 28*d*, which are respectively located most upstream and most downstream as viewed in the image forming process flow, are guided by and inserted into those photo-receptor guide grooves 35. The assembled photo-receptor unit 7 is positioned to and held with the intermediate transfer body unit 18 by means of unit fixing means 37. Thus, in the instant embodiment, the plural photo-receptor units 8 (8*a* to 8*d*) are assembled into one assembled photo-receptor unit 7. Therefore, those photo-receptor units 8 (8*a* to 8*d*) can be replaced with new ones at one time. This feature reduces a frequency of expendable replacements.

<Embodiment 3>

Figure 6:
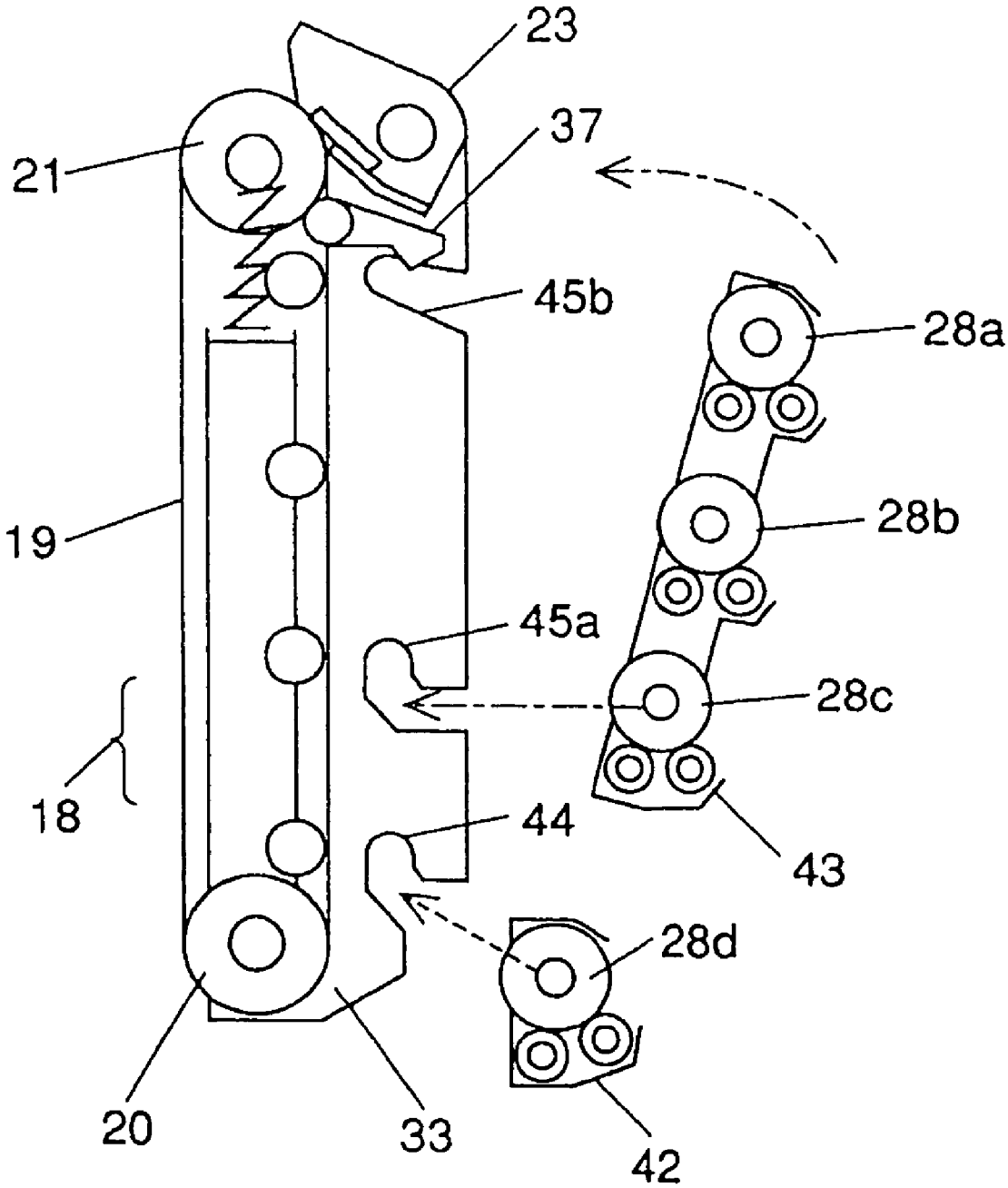
FIG. 6 is a view schematically showing the attaching of an image forming units according to a third embodiment of the invention.

FIG. 6 is a view schematically showing the attaching of the image forming units according to a third embodiment of the invention. No or simple description will be given about the portions in the third embodiment which are the same as and similar to those in the first embodiment.

In the embodiment of FIG. 6, one of plural photo-receptors is fixed to and supported by one housing to form a photo-receptor unit 42. The remaining photo-receptors are fixed to and supported by one housing to form an assembled photo-receptor unit 43. Of those photo-receptor units, the assembled photo-receptor unit 43 is inserted into photo-receptor guide grooves 45 (45*a* and 45*b*) of unit side plates 33 that are provided on both sides of the intermediate transfer body unit 18 such that the rotation center shafts of the photo-receptors 28*a* and 28*c*, which are respectively located most upstream and downstream as viewed in the image forming process flow are guided by and inserted into those photo-receptor guide grooves 45. The assembled photo-receptor 43 is positioned to and held with the intermediate transfer body unit 18 by a unit fixing means 37. The photo-receptor unit 42 is inserted into photo-receptor guide grooves 44 of the unit side plates 33 that are provided on both sides of the intermediate transfer body unit 18 such that the rotation center shaft of the photo-receptor 28*d* is guided by and inserted into those photo-receptor guide grooves 44. And, the photo-receptor unit 42 is positioned to and held with the intermediate transfer body unit 18.

As described above, in the instant embodiment, the photo-receptors are divided into two photo-receptor units, the photo-receptor unit 42 and the assembled photo-receptor unit 43. The reason for this follows. The color image forming apparatus is generally operated in two print modes, a monochromatic print mode and a color print mode. The frequencies of using those print modes are almost equal. Accordingly, if the photo-receptors are divided into the photo-receptor unit 42 for black printing and he assembled photo-receptor unit 43 for color (Y, M, C) printing, the photo-receptor unit may be replaced with a new one according to the frequency of using the photo-receptor or photo-receptors. Therefore, the work of replacing the image forming units as expendables is enhanced, and further the running cost of the apparatus is reduced. Operation of the instant embodiment is omitted since the operations of the second and third embodiments are correspondingly applied to the instant embodiment.

While some specific embodiments of the present invention has been described, the invention is not limited to such embodiments, but maybe variously modified, altered and changed within the true spirits of the invention. Further, it is readily understood that the number, positions, shapes and others of component parts are not limited to those described in the embodiments, but those may be altered and changed within design modification.

<Forth Embodiment>

Figure 7:
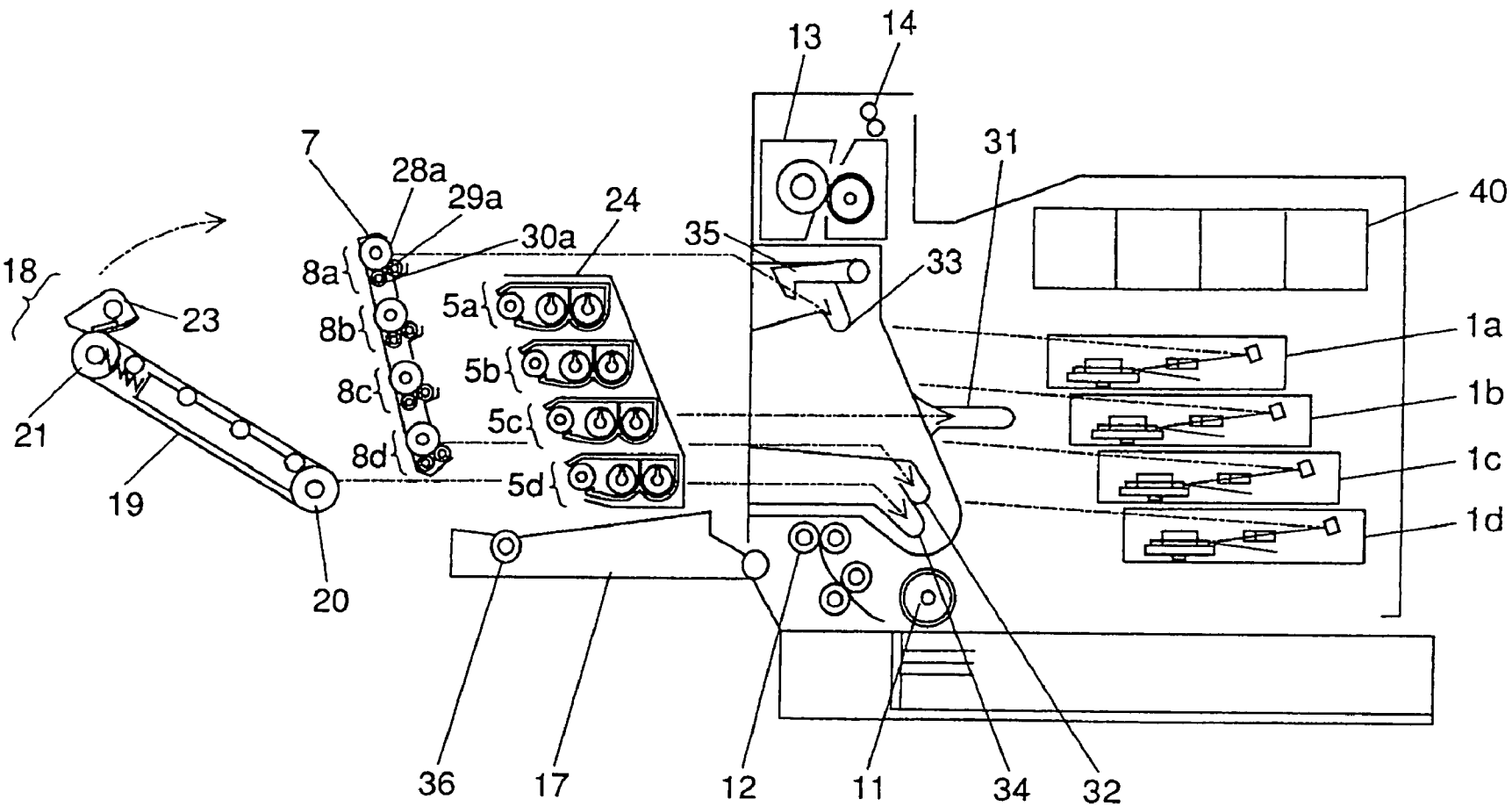
FIG. 7 is a view schematically showing the attaching of an image forming units according to a fourth embodiment of the invention.
Figure 8:
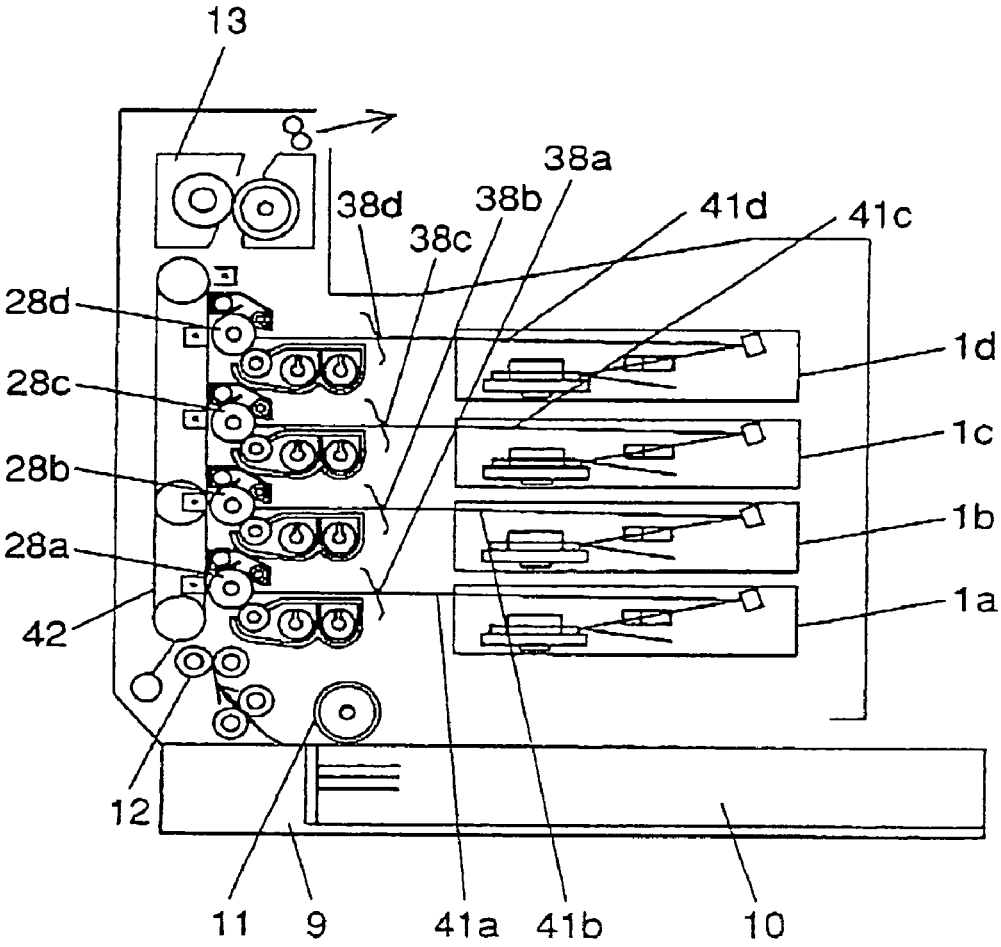
FIG. 8 Conventional Art
FIG. 8 is a view schematically showing a conventional image forming apparatus.

Reference is made to FIG. 7. Each photo-receptor unit 8 (8*a* to 8*d*) used in the instant embodiment may be installed as one unit in a guide part (not shown) of the apparatus main body. In the instant embodiment, however, to improve the maintenance for replacement, the photo-receptor units 8 (8*a* to 8*d*) are supportingly fixed to one housing by means of screws in a state that the rotation center axes of the photo-receptors are aligned with one another (The thus assembled photo-receptor units will be referred to as an assembled photo-receptor unit 7.). When the assembled photo-receptor unit 7 is installed into the apparatus main body, the photo-receptor units are vertically and obliquely arranged from upstream to downstream sides as viewed in a color forming process flow, while being successively shifted to optical units 1 (1*a* to 1*d*) disposed on the rear side of the apparatus (on the right side on a paper surface of the drawing).

FIG. 7 is a view showing an image forming apparatus according to the fourth embodiment of the invention. A housing of the main body is constructed as shown in FIG. 7, a door 17 is attached to the left side of the apparatus main body. When the door 17 is opened, a component attaching opening is formed in the apparatus main body. The assembled developing unit 24, the assembled photo-receptor unit 7 and the intermediate transfer body unit 18 are inserted into and taken out of the apparatus main body. A transfer roller 36 is mounted on the door 17. When the door 17 is closed, the transfer roller 36 collectively transfers the toner images from the intermediate transfer belt 19 onto a recording sheet at a position where it is confronted with the upper belt follower roller 21 which tensionally supports the intermediate transfer belt 19.

In the instant embodiment, as shown in FIG. 1, the sheet supply cassette 9 includes a feed roll 11 for feeding recording sheets 10 at predetermined timings. A registration roller 12 as nip transporting means is provided at position near an input of a sheet transporting path which is located between the feed roll 11 and a secondary transfer part. A sheet sensor (not shown) of the optical type is located downstream of the registration roller. In the instant embodiment, the sheet sensor detects the leading edge of the recording sheet 10. A timing of detecting the sheet leading end by the sensor is used for controlling, for example, writing timings of electrostatic latent images in the optical units 1 (1*a* to 1*d*) in the image forming units 5 (5*a* to 5*d*).

A fixing device 13 as nip transfer means is provided on a sheet transporting path, which is located downstream of the secondary transfer part. The fixing device 13 includes a heating roll 15 and a pressing roll 16.

A sheet-discharging roll 14 is located downstream of the fixing device 13. Recording sheets emanating from the sheet-discharging roll are discharged into a sheet receiving tray provided in an upper part of the housing.

As described above, the intermediate transfer belt 19 is obliquely disposed which is transportingly rotated in a state that the intermediate transfer belt 19 is tensionally supported by at least two rollers (the lower drive roller and the upper follower roller). The plurality of photo-receptors 28 are arranged along a surface of the intermediate transfer belt 19 which is transportingly moved from upper to lower sides (from upper to lower in a paper surface of the drawing). Toner images are successively transferred onto the intermediate transfer belt 19 to form a toner image of different colors. The toner image is transferred onto a recording sheet by using the transfer unit including the upper follower roller 21 which tensionally supports the intermediate transfer belt, and the transfer roller 36. Thereafter, the color image is fixed by use of the fixing unit 13.

As described above, in the instant embodiment, the plurality of image forming units are obliquely disposed while being successively shifted to the optical units. This feature advantageously brings about reduction of an installation area and a height of a main body of the color image forming apparatus, and a size of the whole image forming apparatus.

Figure 4:
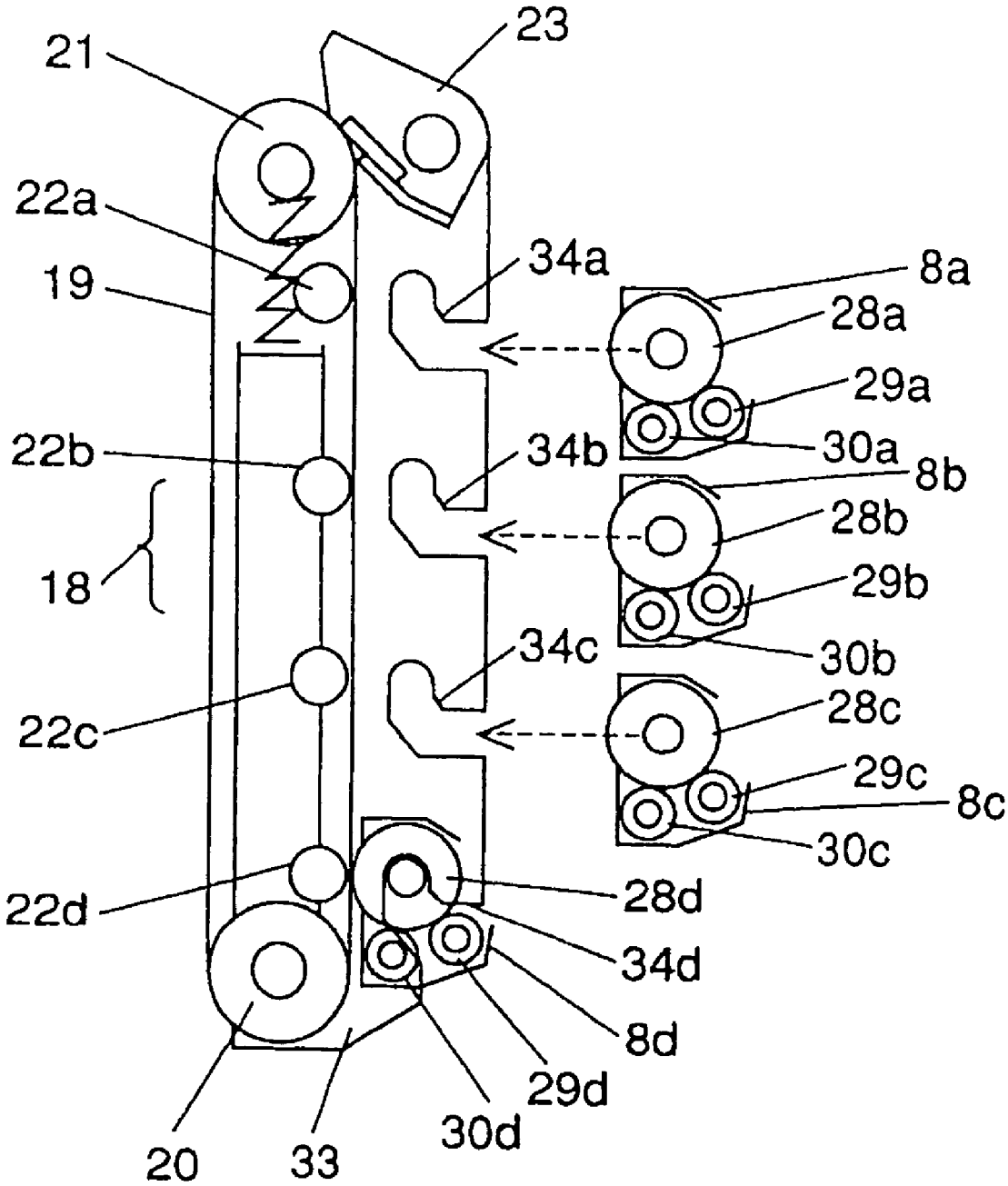
FIG. 4 is a view schematically showing the attaching of the image forming units in the first embodiment.

As apparent from the first embodiment shown in FIG. 4, the photo-receptor units and the intermediate transfer body unit may be handled as if those are integrally assembled into one cartridge. This cartridge may be detachably mounted to the image forming apparatus.

In the instant embodiment, as shown in FIG. 1, the intermediate transfer belt is obliquely disposed which is transportingly rotated in a state that the intermediate transfer belt is tensionally supported by at least two rollers, the lower drive roller and the upper follower roller. The plurality of photo-receptors are arranged along a surface of the intermediate transfer belt which is transportingly moved from upper to lower sides. The toner image is transferred onto a recording sheet by using the transfer unit including the upper follower roller which tensionally supports the intermediate transfer belt, and the transfer roller. Further, in the color image forming apparatus, a fixing unit is disposed above the image forming units, and a sheet transport path, shaped like U, is disposed on the opposite side of the photo-receptors with respect to the intermediate transfer belt, and recording sheets are supplied upward from a sheet supply unit located in a lower-most part. With this feature, excessive rise of temperature within the apparatus when the fixing unit is heated is suppressed. A color picture is stably formed. An operator can attach and detach the intermediate transfer body unit and the image forming units to and from the apparatus main body, and can remove a jammed sheet, while being confronted with the sheet transporting surface. While some specific embodiments of the present invention has been described, the invention is not limited to such embodiments, but may be variously modified, altered and changed within the true spirits of the invention. Further, it is readily understood that the number, positions, shapes and others of component parts are not limited to those described in the embodiments, but those may be altered and changed within design modification. Throughout the drawings, like or equivalent portions are designated by like reference numerals.

The present invention which is constructed as described above has the following advantages. Since the plurality of image forming units are individually positioned to and held with the intermediate transfer body unit, the photo-receptor units and the intermediate transfer body unit may be handled as if those are integrally assembled into one cartridge. This structural feature accrues to many advantages. Sufficient strength of the image forming units is secured while the size of the whole image forming apparatus is reduced. The stable picture quality is ensured regardless of the thickness and a moisture absorbing property of the sheet and others. Further, the user can remove a jammed sheet at the time of paper jamming.

The image forming units have proper sizes when those are handled as expendables. A sufficient working space is secured. Operability in the replacing work of the image forming units is enhanced.

In an embodiment of the invention, a plurality of photo-receptors are fixedly supported by one housing to form an assembled photo-receptor unit, and the assembled photo-receptor unit is positioned to and held with the intermediate transfer body unit. Since the plurality of image forming units are assembled into one assembled photo-receptor unit, the plural photo-receptors can be replaced with new ones at one time, and a frequency of replacing expendables with new ones is reduced.

In another embodiment of the invention, one of plural photo-receptors is fixed to and supported by one housing to form a photo-receptor unit, and the remaining photo-receptors are fixed to and supported by one housing to form an assembled photo-receptor unit. The photo-receptor unit and the assembled photo-receptor unit are individually positioned to and held with the intermediate transfer body unit. With this feature, the photo-receptor unit may be replaced with a new one according to the frequency of using the two print modes, the monochromatic print mode and the color print mode. Therefore, the work of replacing the image forming units as expendables is enhanced, and further the running cost of the apparatus is reduced.

The present invention which is constructed as described above has the following advantages. In the instant embodiment, the plurality of image forming units are obliquely disposed while being successively shifted to the optical units. This feature advantageously brings about reduction of an installation area and a height of a main body of the color image forming apparatus, and a size of the whole image forming apparatus.

Further, the recording sheet is transported along the sheet transporting path located on the opposite side of the photo-receptors with respect to the intermediate transfer belt. This feature makes it easy for the user to remove a jammed sheet at the time of paper jamming. An operator can attach and detach the intermediate transfer body unit and the image forming units to and from the apparatus main body, and can remove a jammed sheet, while being confronted with the sheet transporting surface.

Further, the fixing unit is disposed above the image forming units. Excessive rise of temperature within the apparatus when the fixing unit is heated is suppressed. A color picture is stably formed.

Furthermore, the intermediate transfer belt cleaner is disposed facing the upper follower roller which tensionally supports the intermediate transfer belt, at a position closer to the image forming units. Accordingly, the intermediate transfer belt cleaner may be stably pressed on the intermediate transfer belt. This feature stabilizes the cleaning performance. Additionally, it enables waste toner (not shown) discharged from the intermediate transfer belt cleaner to outside and waste toner (not shown) discharged from the image forming units to drop into one waste toner (not shown) box (not shown).

What is claimed is:

1. A color image forming apparatus, comprising:

a plurality of developing units for containing different color toners to form a color image;

a plurality of photo-receptor units including photo-receptors on which electrostatic latent images to be developed by said developing units are to be formed;

an intermediate transfer body unit including a tensionally provided belt with upper and lower surfaces to which toner images are transferred from said photo-receptors;

a jamming-removal opening, provided in a side surface of said color image forming apparatus, for removing a jammed recording sheet;

a developing unit cartridge integrally holding said plurality of developing units, said cartridge being detachably attached to said color image forming apparatus through said jamming-removal opening;

a photo-receptor unit cartridge integrally holding said plurality of photo-receptor units, said photo-receptor unit cartridge being detachably attached to said color image forming apparatus through said jamming-removal opening; and an intermediate transfer body unit cartridge integrally holding said intermediate transfer body unit, said intermediate transfer body unit cartridge being detachably attached to said color image forming apparatus through said jamming-removal opening, said intermediate transfer body unit cartridge being obliquely inclined with respect to said developing unit cartridge when said intermediate transfer body unit cartridge and said developing unit cartridge are installed in said color image forming apparatus.

2. A color image forming apparatus according to claim 1, further comprising:

a sheet supply cassette disposed in a lower part of said color image forming apparatus;

a sheet discharge tray disposed in an upper part of said color image forming apparatus; and a transporting mechanism that transports a recording sheet from said sheet supply cassette to said sheet discharge tray, wherein said jamming-removal opening is disposed in a vicinity of said transporting mechanism.

3. A color image forming apparatus according to claim 1, wherein said photo-receptor unit cartridge is integrally coupled with said intermediate transfer body unit cartridge.

4. A color image forming apparatus according to claim 2, wherein said photo-receptor unit cartridge is integrally coupled with said intermediate transfer body unit cartridge.

5. A color image forming apparatus according to claim 3, wherein said developing unit cartridge is integrally coupled with said photo-receptor unit cartridge.

6. A color image forming apparatus according to claim 4, wherein said developing unit cartridge is integrally coupled with said photo-receptor unit cartridge.

7. A color image forming apparatus according to claim 1, wherein said photo-receptor unit cartridge is divided into a plurality of sub-cartridges.

8. A color image forming apparatus according to claim 2, wherein said photo-receptor unit cartridge is divided into a plurality of sub-cartridges.

9. A color image forming apparatus according to claim 3, wherein said photo-receptor unit cartridge is divided into a plurality of sub-cartridges.

10. A color image forming apparatus according to claim 4, wherein said photo-receptor unit cartridge is divided into a plurality of sub-cartridges.

11. A color image forming apparatus according to claim 5, wherein said photo-receptor unit cartridge is divided into a plurality of sub-cartridges.

12. A color image forming apparatus according to claim 6, wherein said photo-receptor unit cartridge is divided into a plurality of sub-cartridges.

13. A color image forming apparatus according to claim 2, wherein said plurality of photo-receptor units, said plurality of developing units, and an optical unit are disposed closer to said upper surface of said belt, and said transporting mechanism is disposed closer to said lower surface of said belt.

14. A color image forming apparatus according to claim 4, wherein said plurality of photo-receptor units, said plurality of developing units, and an optical unit are disposed closer to said upper surface of said belt, and said transporting mechanism is disposed closer to said lower surface of said belt.

15. A color image forming apparatus according to claim 6, wherein said plurality of photo-receptor units, said plurality of developing units, and an optical unit are disposed closer to said upper surface of said belt, and said transporting mechanism is disposed closer to said lower surface of said belt.

16. A color image forming apparatus according to claim 8, wherein said plurality of photo-receptor units, said plurality of developing units, and an optical unit are disposed closer to said upper surface of said belt, and said transporting mechanism is disposed closer to said lower surface of said belt.

17. A color image forming apparatus according to claim 10, wherein said plurality of photo-receptor units, said plurality of developing units, and an optical unit are disposed closer to said upper surface of said belt, and said transporting mechanism is disposed closer to said lower surface of said belt.

18. A color image forming apparatus according to claim 12, wherein said plurality of photo-receptor units, said plurality of developing units, and an optical unit are disposed closer to said upper surface of said belt, and said transporting mechanism is disposed closer to said lower surface of said belt.

19. A color image forming apparatus, comprising:

a plurality of developing units for containing different color toners to form a color image;

a plurality of photo-receptor units including photo-receptors on which electrostatic latent images to be developed by said developing units are to be formed;

an intermediate transfer body unit including a tensionally provided belt with upper and lower surfaces to which toner images are transferred from said photo-receptors;

a jamming-removal opening, provided in a side surface of said color image forming apparatus, for removing a jammed recording sheet;

a developing unit cartridge integrally holding said plurality of developing units, said cartridge being detachably attached to said color image forming apparatus through said jamming-removal opening;

a photo-receptor unit cartridge integrally holding said plurality of photo-receptor units, said photo-receptor unit cartridge being detachably attached to said color image forming apparatus through said jamming-removal opening; and an intermediate transfer body unit cartridge integrally holding said intermediate transfer body unit, said intermediate transfer body unit cartridge being detachably attached to said color image forming apparatus through said jamming-removal opening, wherein said photo-receptor units are configured to attach to said intermediate transfer body unit via at least one groove formed in a side of said intermediate transfer body unit, and be removed from the color image forming apparatus with removal of the intermediate transfer body unit from the color image forming apparatus.

20. A color image forming apparatus, comprising:

a plurality of photo-receptor units, each photo-receptor unit including a photo-receptor on which electrostatic latent images are to be formed; and an intermediate transfer body unit, removable from the color image forming apparatus, which includes a belt to which toner images are transferred from said photo-receptors, wherein said photo-receptor units are configured to attach to said intermediate transfer body unit via at least one groove formed in a side of said intermediate transfer body unit, and be removed from the color image forming apparatus with removal of the intermediate transfer body unit from the color image forming apparatus.

* * * * *